US009834004B2

(12) United States Patent
Ishii et al.

(10) Patent No.: US 9,834,004 B2
(45) Date of Patent: Dec. 5, 2017

(54) FLOW CHANNEL STRUCTURE AND LIQUID EJECTING APPARATUS

(71) Applicant: SEIKO EPSON CORPORATION, Tokyo (JP)

(72) Inventors: Hiroyuki Ishii, Shiojiri (JP); Taiki Hanagami, Matsumoto (JP); Isamu Togashi, Matsumoto (JP); Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/922,394

(22) Filed: Oct. 26, 2015

(65) Prior Publication Data

US 2016/0114592 A1 Apr. 28, 2016

(30) Foreign Application Priority Data

Oct. 27, 2014 (JP) ..... 2014-218731
Jul. 7, 2015 (JP) ..... 2015-136376

(51) Int. Cl.
*B41J 2/175* (2006.01)

(52) U.S. Cl.
CPC ..... *B41J 2/17596* (2013.01); *B41J 2/175* (2013.01); *B41J 2/17563* (2013.01)

(58) Field of Classification Search
CPC .... B41J 2/175; B41J 2/17503; B41J 2/17513; B41J 2/17556; B41J 2/17563; B41J 2/17596; B41J 2/19
See application file for complete search history.

(56) References Cited

U.S. PATENT DOCUMENTS

2004/0113969 A1* 6/2004 Kwan ..... B29C 65/1635 347/20
2009/0073217 A1* 3/2009 Yaneda ..... B41J 2/175 347/30
2011/0083758 A1 4/2011 Tsujiuchi et al.
2011/0242239 A1* 10/2011 Hara ..... B41J 2/17563 347/93
2012/0241368 A1* 9/2012 Hara ..... B41J 2/17563 210/257.1

FOREIGN PATENT DOCUMENTS

JP 2007111403 A * 5/2007
JP 2011-046070 3/2011
JP 2011 046070 3/2011
JP 2011-079244 4/2011

OTHER PUBLICATIONS

Oshimi, MachineTranslationofJP2007111403A aka JP4111242B2, 2007.*
European Search Report for Application No. 15190649.2 dated Apr. 11, 2016.

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A flow channel structure includes a first flow channel chamber to which an ink is supplied, a first sealing body that configures a wall face of the first flow channel chamber, a valve body that controls flow and blocking of the ink in accordance with deformation of the first sealing body, a second flow channel chamber that communicates with the first flow channel chamber, and a second sealing body that configures a wall face of the second flow channel chamber, in which the rigidity of the second sealing body is greater than the rigidity of the first sealing body.

20 Claims, 10 Drawing Sheets

FLOW CHANNEL STRUCTURE AND LIQUID EJECTING APPARATUS

BACKGROUND

1. Technical Field

The present invention relates to a structure of a flow channel where a liquid such as an ink flows.

2. Related Art

Various types of structures for supplying a liquid to a liquid ejecting head which ejects the liquid such as an ink from a plurality of nozzles have been offered. For example, in JP-A-2011-46070, a configuration of forming a flow channel where a filter or a pressure regulating damper is installed in an internal portion by welding a polypropylene (PP) film or a polyethylene terephthalate (PET) film onto both of surfaces of a main body portion has been disclosed. In the configuration of JP-A-2011-46070, a valve for controlling opening and closing of the flow channel is installed on the flow channel.

In the configuration of installing the valve on the flow channel as described in JP-A-2011-46070, there are problems that a pressure difference between a space of an upstream side of the valve and a space of a downstream side of the valve becomes significant, and deformation or breakage of the space is likely to occur in a high pressure side as compared with a low pressure side.

SUMMARY

An advantage of some aspects of the invention is to reduce a possibility of deformation or breakage of a space which configures a flow channel.

Aspect 1

According to a preferable example (Aspect 1) of the invention, there is provided a flow channel structure including a first flow channel chamber to which a liquid is supplied, a first sealing body that configures a wall face of the first flow channel chamber, a valve body that controls flow and blocking of the liquid in accordance with deformation of the first sealing body, a second flow channel chamber that communicates with the first flow channel chamber, and a second sealing body that configures a wall face of the second flow channel chamber, in which the rigidity of the second sealing body is greater than the rigidity of the first sealing body. In Aspect 1, since the rigidity of the second sealing body is greater than the rigidity of the first sealing body, for example, it is possible to reduce a possibility of deformation or breakage of the second flow channel chamber in comparison with a case where the rigidity of the second sealing body is equal to the rigidity of the first sealing body.

Aspects 2 and 3

According to a preferable example (Aspect 2) of Aspect 1, the second flow channel chamber may be positioned on an upstream side of the first flow channel chamber, and an internal pressure of the second flow channel chamber may be higher than that of the first flow channel chamber. According to a preferable example (Aspect 3) of Aspect 2, for example, the internal pressure of the second flow channel chamber may be from 30 kPa to 40 kPa. In Aspect 2 or 3, the internal pressure of the second flow channel chamber is higher than that of the first flow channel chamber. Therefore, some aspects of the invention which can reduce the possibility of the deformation or the breakage of the second flow channel chamber are particularly suitable.

Aspect 4

According to a preferable example (Aspect 4) of Aspect 2 or 3, a first filter that faces the second sealing body by being installed in the second flow channel chamber may be further included. Since the deformation of the second sealing body is controlled by the configuration in which the rigidity of the second sealing body is greater than the rigidity of the first sealing body as described above, it is possible to reduce the possibility of closing the first filter by that the second sealing body is in contact with the first filter due to the deformation in Aspect 4.

Aspect 5

According to a preferable example (Aspect 5) of any one of Aspects 1 to 4, a base body where the first sealing body and the second sealing body are installed may be further included. In Aspect 5, since the first sealing body and the second sealing body are installed in the common base body, for example, there is an advantage that the flow channel structure is miniaturized in comparison with a configuration of installing the first sealing body and the second sealing body in components which are different from each other.

Aspect 6

According to a preferable example (Aspect 6) of Aspect 5, a protruding portion that is installed on a surface of the base body may be further included, and a protruding engagement portion which engages with the protruding portion may be formed in the second sealing body. According to Aspect 6, it is possible to determine a position of the second sealing body by that the protruding engagement portion of the second sealing body engages with the protruding portion on the surface of the base body.

Aspect 7

According to a preferable example (Aspect 7) of Aspect 5 or 6, a sealing body engagement portion of a shape correlating with the first sealing body may be formed in the second sealing body, and the first sealing body may engage with the sealing body engagement portion. According to Aspect 7, it is possible to determine a position of the first sealing body by that the first sealing body engages with the sealing body engagement portion of the second sealing body.

Aspect 8

According to a preferable example (Aspect 8) of Aspect 6, a protruding engagement portion which engages with the protruding portion may be formed in the first sealing body. According to Aspect 8, it is possible to determine the positions of the first sealing body and the second sealing body by that the protruding engagement portions of the first sealing body and the second sealing body engage with the common protruding portion.

Aspect 9

According to a preferable example (Aspect 9) of any one of Aspects 5 to 8, the second sealing body may be fixed to a joining portion which protrudes from the surface of the base body, the joining portion may include a first portion surrounding the second flow channel chamber in a planar view, and a second portion surrounding a flow channel which communicates with the second flow channel chamber in the planar view, and the first portion and the second portion may have the same portion between the second flow channel chamber and the flow channel. In Aspect 9, since the first portion and the second portion of the joining portion for fixing the second sealing body have the same portion, there is an advantage that the area which is necessary for the formation of the joining portion is reduced (in addition to that it is possible to miniaturize the flow channel structure) in comparison with a configuration of independently forming the first portion and the second portion to be separated from each other.

Aspect 10

According to a preferable example (Aspect 10) of Aspect 1, a first filter that faces the second sealing body by being installed in the second flow channel chamber may be further included, and the second flow channel chamber may be positioned on a downstream side of the first flow channel chamber. Since the deformation of the second sealing body is controlled by the configuration in which the rigidity of the second sealing body is greater than the rigidity of the first sealing body as described above, it is possible to reduce the possibility of closing the first filter by that the second sealing body is in contact with the first filter due to the deformation in Aspect 10.

Aspect 11

According to a preferable example (Aspect 11) of Aspect 10, a base body that includes a first face and a second face which are positioned on opposite sides to each other may be further included, and the first sealing body may be installed on the first face, and the second sealing body may be installed on the second face. In Aspect 11, since the first sealing body and the second sealing body are installed on the opposite sides to each other by interposing the base body therebetween, there is an advantage that a size of the flow channel structure may be reduced in comparison with a configuration of installing the first sealing body and the second sealing body on the surface of one side of the base body so as not to overlap with each other.

Aspect 12

According to a preferable example (Aspect 12) of Aspect 10 or 11, a second filter that is arranged on an upstream side of the first flow channel chamber may be further included, and the first filter may have a fine mesh, and a large area in comparison with the second filter. According to Aspect 12, it is possible to supply the liquid to the downstream side after collecting a minute foreign material or air bubbles by the first filter of which the mesh is fine in comparison with the second filter. Meanwhile, since the first filter has the large area in comparison with the second filter, flow channel resistance of the first filter is suppressed in spite of the configuration in which the mesh of the first filter is fine.

Aspect 13

According to a preferable example (Aspect 13) of any one of Aspects 10 to 12, at least a portion the first filter, and at least a portion of the first flow channel chamber may overlap with each other when viewed from a direction which is perpendicular to the wall face of the first sealing body or the second sealing body. In Aspect 13, since the first filter and the first flow channel chamber overlap with each other, it is possible to reduce the size of the flow channel structure in comparison with a configuration in which the first filter and the second flow channel chamber do not overlap with each other.

Aspect 14

According to a preferable example (Aspect 14) of any one of Aspects 10 to 13, the area of the first filter may be 50% or more of the area of the first flow channel chamber. More preferably, the area of the first filter may be 90% or more (ideally, 100%) of the area of the first flow channel chamber. According to Aspect 14, there is an advantage that the flow channel resistance may be effectively suppressed by sufficiently securing the area of the first filter.

Aspect 15

According to a preferable example (Aspect 15) of any one of Aspects 10 to 14, the second sealing body may be transparent. In Aspect 15, since the second sealing body is transparent, there is an advantage that the air bubbles or the foreign materials which are collected by the first filter can be visually confirmed through the second sealing body (in addition to that it is possible to determine whether or not an exchange of the first filter is necessary).

Aspect 16

According to a preferable example (Aspect 16) of Aspect 3 or 10, the first filter may be fixed to an installation portion which protrudes from the surface of the base body, the second sealing body may be fixed to a joining portion which protrudes from the surface of the base body, and a groove portion for heat radiation may be formed between the installation portion and the joining portion in the base body. In Aspect 16, since the groove portion for heat radiation is formed between the installation portion and the joining portion, for example, there is an advantage of reducing the possibility that the heat radiates up to the joining portion in a process of welding the first filter to the installation portion.

Aspect 17

According to a preferable example (Aspect 17) of Aspect 5 or 11, the base body may absorb a laser beam, and the second sealing body may transmit the laser beam. In Aspect 17, it is possible to fix the second sealing body to the base body by a laser welding of irradiating and melting the base body with the laser beam which is transmitted through the second sealing body.

Aspect 18

According to a preferable example (Aspect 18) of the invention, there is provided a liquid ejecting apparatus including the flow channel structure according to any one of Aspect 1 to Aspect 17, and a liquid ejecting head that ejects a liquid which is supplied from the flow channel structure. The liquid ejecting apparatus is preferably a printing apparatus which ejects an ink, but an application of the liquid ejecting apparatus according to Aspect 18 of the invention is not limited to the printing.

Aspect 19

According to a preferable example (Aspect 19) of the invention, there is provided a liquid ejecting apparatus including a first liquid ejecting unit including the flow channel structure according to any one of Aspect 1 to Aspect 17, and a liquid ejecting head that ejects a liquid which is supplied from the flow channel structure, and a second liquid ejecting unit including the flow channel structure according to any one of Aspect 1 to Aspect 17, and a liquid ejecting head that ejects a liquid which is supplied from the flow channel structure, in which the first sealing body of the flow channel structure of the first liquid ejecting unit, and the first sealing body of the flow channel structure of the second liquid ejecting unit face each other. In Aspect 19, since the first liquid ejecting unit and the second liquid ejecting unit are installed so that the first sealing bodies of the rigidity which is low in comparison with the second sealing body face each other, for example, there is an advantage that the first sealing bodies of the respective liquid ejecting units can be protected from a collision with an external component, for example, in comparison with a configuration in which the first sealing bodies of the respective liquid ejecting units are positioned on the opposite sides to each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
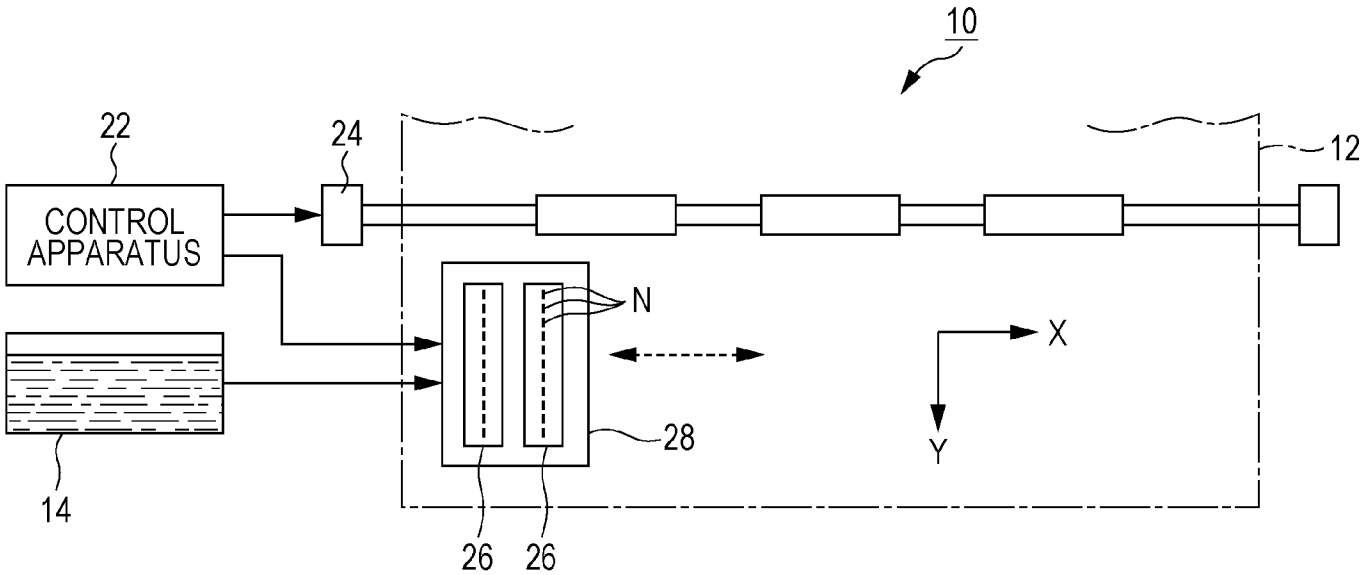
FIG. 1 is a configuration diagram of a printing apparatus according to a first embodiment of the invention.

FIG. 1 is a partial configuration diagram of an ink jet type printing apparatus 10 according to a first embodiment of the invention. The printing apparatus 10 of the first embodiment is a liquid ejecting apparatus that ejects an ink being an example of a liquid onto a medium (ejecting target) 12 such as printing paper. As illustrated in FIG. 1, the printing apparatus 10 includes a control apparatus 22, a transport mechanism 24, a plurality of liquid ejecting units 26, and a carriage 28. A liquid container (cartridge) 14 which stores the ink is installed in the printing apparatus 10.

The control apparatus 22 generally controls each of components of the printing apparatus 10. The transport mechanism 24 transports the medium 12 in a Y direction on the basis of a control by the control apparatus 22. The respective liquid ejecting units 26 eject the ink which is supplied from the liquid container 14 onto the medium 12 from each of a plurality of nozzles N on the basis of the control by the control apparatus 22. The plurality of liquid ejecting units 26 of the first embodiment are mounted in the carriage 28. The control apparatus 22 makes the carriage 28 reciprocate in an X direction intersecting with the Y direction. A desired image is formed on a surface of the medium 12 by that the respective liquid ejecting units 26 eject the ink onto the medium 12 in parallel with a repeat of the transport of the medium 12 and the reciprocation of the carriage 28.

Figure 2:
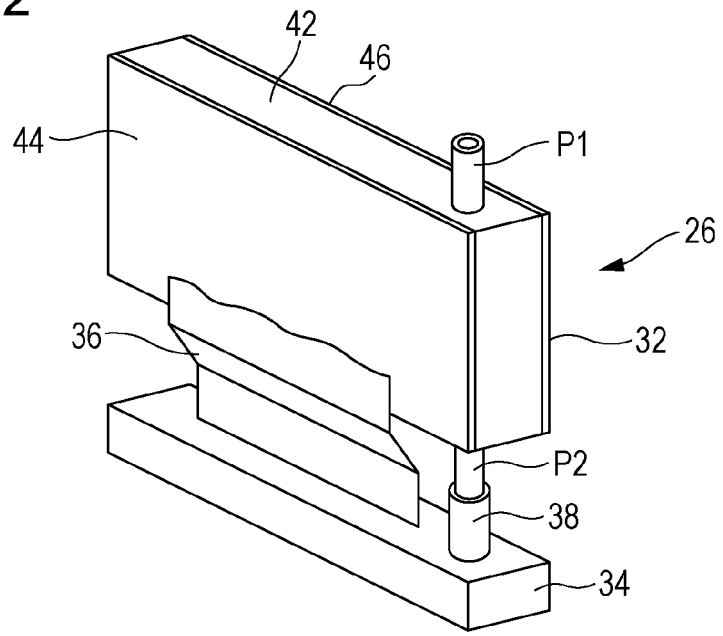
FIG. 2 is a perspective view of a liquid ejecting unit.

FIG. 2 is a perspective view of any one of the liquid ejecting units 26. As illustrated in FIG. 2, the liquid ejecting unit 26 of the first embodiment includes a flow channel structure 32, a liquid ejecting head 34, and a wiring circuit board 36. The flow channel structure 32 of the first embodiment is a structure of a substantially flat plate shape that includes a supply flow channel (supply port) P1, and a discharge flow channel (discharge port) P2. The flow channel structure 32 discharges the ink which is supplied to the supply flow channel P1 from the liquid container 14, to the discharge flow channel P2 through an internal flow channel. The liquid ejecting head 34 is connected to the discharge flow channel P2 of the flow channel structure 32 through a supply pipe 38, and ejects the ink which is supplied from the discharge flow channel P2 of the flow channel structure 32 through the supply pipe 38, from the plurality of nozzles N. Specifically, the liquid ejecting head 34 includes a plurality of sets (not illustrated) of a pressure chamber and a piezoelectric element correlating with the nozzles N which are different from each other. As illustrated in FIG. 2, for example, the wiring circuit board 36 having flexibility such as a flexible printed circuit (FPC) or a flexible flat cable (FFC) is connected to the liquid ejecting head 34. A wiring which supplies a drive signal and a power supply voltage for driving each piezoelectric element from an external apparatus such as the control apparatus 22 to the liquid ejecting head 34, is formed in the wiring circuit board 36. A pressure within the pressure chamber is changed by vibrating the piezoelectric element depending on the drive signal and the power supply voltage which are supplied through the wiring circuit board 36, and thereby, the ink with which the pressure chamber is filled is ejected from each nozzle N.

Figure 3:
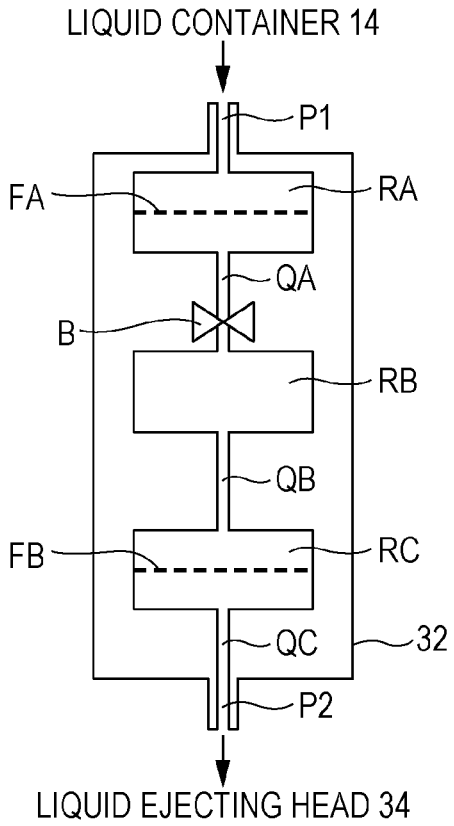
FIG. 3 is a diagram for describing an internal flow channel of a flow channel structure.

FIG. 3 is a diagram for describing the flow channel which is formed in an internal portion of the flow channel structure 32. As illustrated in FIG. 3, the flow channel structure 32 of the first embodiment includes a plurality of flow channels Q (QA, QB, QC), and a plurality of flow channel chambers R (RA, RB, RC) between the supply flow channel P1 and the discharge flow channel P2. Each flow channel Q is a flow channel where the ink flows, and each flow channel chamber R is a space which communicates with each flow channel Q.

As illustrated in FIG. 3, the flow channel chamber RA is a space which communicates with each of the supply flow channel P1 and the flow channel QA by being formed between the supply flow channel P1 and the flow channel QA. A filter FA (example of a second filter) is installed in the flow channel chamber RA. The filter FA collects air bubbles or a foreign material from the ink which is supplied to the flow channel chamber RA from the supply flow channel P1. The ink where the air bubbles or the foreign materials are removed by passing through the filter FA is supplied to the flow channel QA from the flow channel chamber RA.

The flow channel chamber RB is a space (example of a first flow channel chamber) communicating with each of the flow channel QA and the flow channel QB by being formed therebetween. An adjusting mechanism B is installed between the flow channel QA and the flow channel chamber RB. The adjusting mechanism B of the first embodiment is a valve mechanism that controls opening and closing (opening and blocking) of the flow channel QA depending on the pressure (negative pressure) within the flow channel chamber RB. The ink flowing into the flow channel chamber RB from the flow channel QA is supplied to the flow channel QB in a state where the adjusting mechanism B opens the flow channel QA.

The flow channel chamber RC is a space (example of a second flow channel chamber) which communicates with each of the flow channel QB and the flow channel QC by being formed between the flow channel QB and the flow channel QC. A filter FB (example of a first filter) is installed in the flow channel chamber RC. The filter FB collects the air bubbles or the foreign material from the ink which is supplied to the flow channel chamber RC from the flow channel QB. The ink passing through the filter FB is supplied to the flow channel QC, and is supplied to the liquid ejecting head 34 from the discharge flow channel P2 which communicates with the flow channel QC.

As understood from the above description, the flow channel QB (second flow channel) is positioned on a downstream side of the flow channel QA (first flow channel), and the flow channel QC (third flow channel) is positioned on the downstream side of the flow channel QB. Moreover, the filter FA is installed on an upstream side of the adjusting mechanism B, and the filter FB is installed on the downstream side of the adjusting mechanism B.

Figure 4:
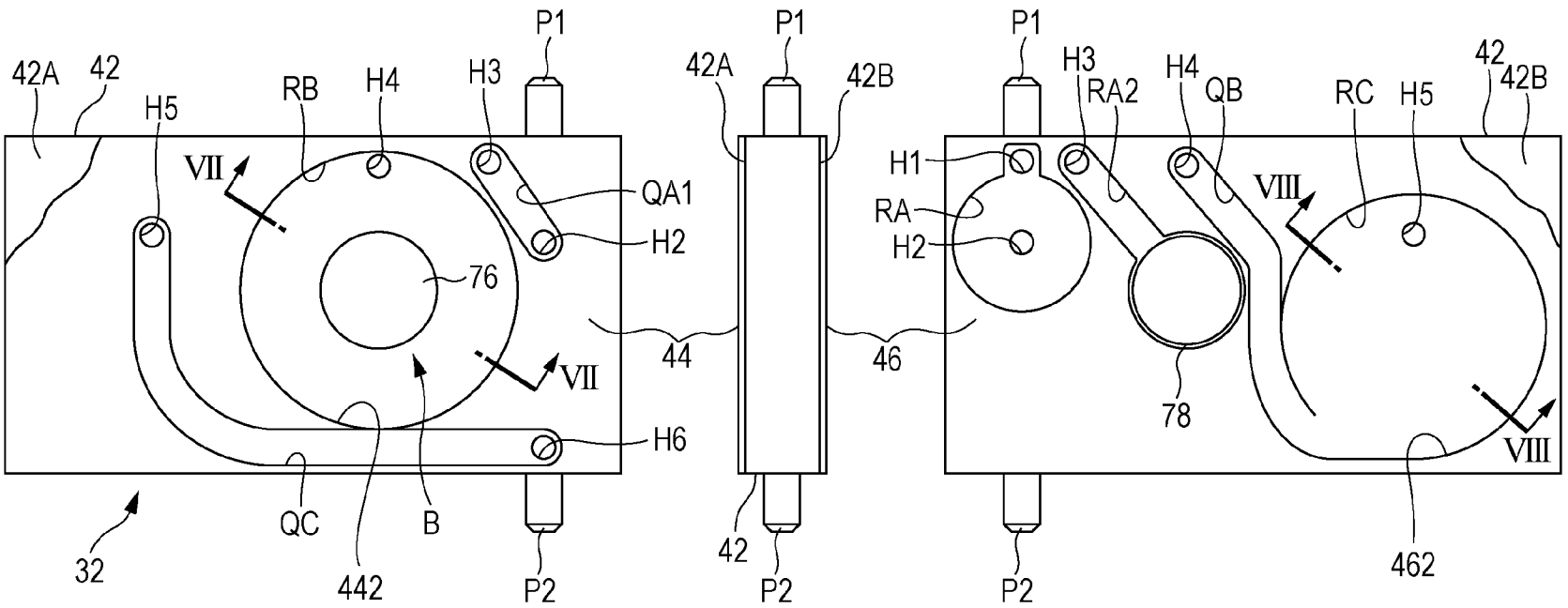
FIG. 4 is a configuration diagram of the flow channel structure.

FIG. 4 is a configuration diagram of the flow channel structure 32. As illustrated in FIG. 2 and FIG. 4, the flow channel structure 32 of the first embodiment includes a base body 42, a sealing body 44 (example of a first sealing body), and a sealing body 46 (example of a second sealing body). The base body 42 is a structure of a substantially flat plate shape that includes a first face 42A, and a second face 42B which are positioned on opposite sides to each other. For example, the base body 42 is formed by an injection molding of a resin material. The base body 42 of the first embodiment is formed of polypropylene (PP). As illustrated in FIG. 4, the supply flow channel P1 having a substantially circular pipe shape is formed on an upper face of the base body 42, and the discharge flow channel P2 having a substantially circular pipe shape is formed on a bottom face of the base body 42. For example, each of the sealing body 44 and the sealing body 46 are flat plate-shaped (film-shaped) members which are formed of the resin materials. The sealing body 44 is joined to the first face 42A of the base body 42, and the sealing body 46 is joined to the second face 42B of the base body 42. In FIG. 4, a portion of the sealing body 44 and the sealing body 46 is broken for convenience of the description.

Figure 5:
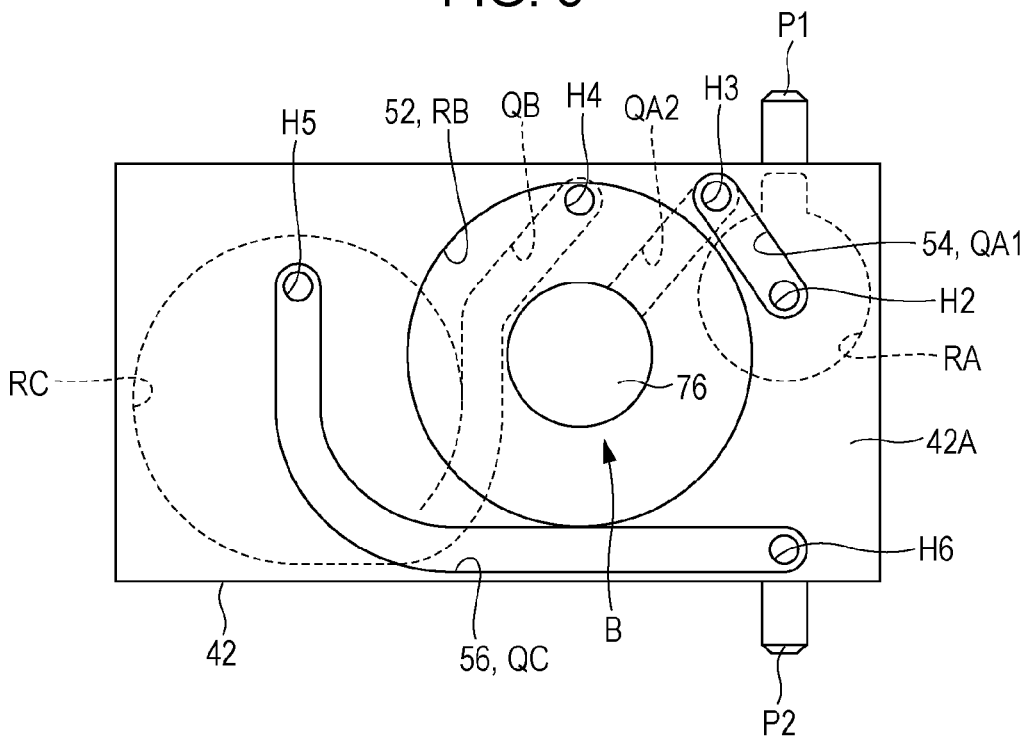
FIG. 5 is a plan view of a first face of a base body in the flow channel structure.
Figure 6:
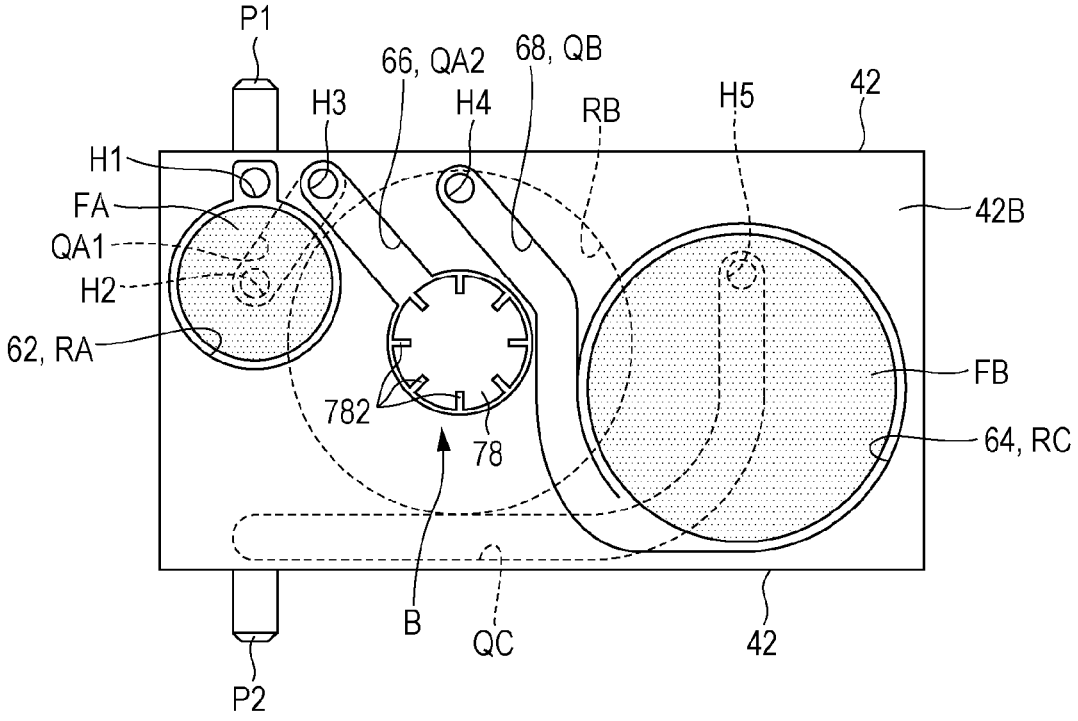
FIG. 6 is a plan view of a second face of a base body in the flow channel structure.

FIG. 5 is a plan view of the first face 42A of the base body 42, and FIG. 6 is a plan view of the second face 42B of the base body 42. As illustrated in FIG. 5, a concave portion 52, a groove portion 54, and a groove portion 56 are formed on the first face 42A of the base body 42, and are sealed by the sealing body 44 which is joined to the first face 42A. The concave portion 52 is a hollow portion which is low in comparison with the first face 42A, and is formed into a substantially circular shape in a planar view (that is, when viewed from a direction which is perpendicular to the first face 42A or the second face 42B). A space which is surrounded by an internal face of the concave portion 52 and a surface (referred to as "sealing face", hereinafter) of the base body 42 side among the sealing body 44 functions as the flow channel chamber RB. As illustrated in FIG. 4, a portion (referred to as "first wall portion", hereinafter) 442 of a circular shape which is positioned on the inside of the concave portion 52 among the sealing body 44 in the planar view, configures a wall face of the flow channel chamber RB by being installed on the first face 42A of the base body 42.

As illustrated in FIG. 6, a concave portion 62, a concave portion 64, and a groove portion 66, a groove portion 68 are formed on the second face 42B of the base body 42, and are sealed by the sealing body 46 which is joined to the second face 42B. Each of the concave portion 62 and the concave portion 64 are hollow portions which are low in comparison with the second face 42B, and are formed into the substantially circular shapes in the planar view. As understood from FIG. 4 and FIG. 6, a space which is surrounded by the internal face of the concave portion 62 and the sealing face of the base body 42 side among the sealing body 46 functions as the flow channel chamber RA, and a space which is surrounded by the internal face of the concave portion 64 and the sealing face of the sealing body 44 functions as the flow channel chamber RC. The flow channel chamber RA communicates with the supply flow channel P1 through a communication hole H1 of the base body 42. As understood from the above description, the flow channel chamber RB is formed on the first face 42A side of the base body 42, and the flow channel chamber RA and the flow channel chamber RC are formed on the second face 42B side of the base body 42.

A space which is surrounded by the internal face of the groove portion 54 of the first face 42A and the sealing face of the sealing body 44 correlates with a portion QA1 of the upstream side (flow channel chamber RA side) among the flow channel QA, and a space which is surrounded by the groove portion 66 of the second face 42B and the sealing face of the sealing body 46 correlates with a portion QA2 of the downstream side (flow channel chamber RB side) among the flow channel QA. As illustrated in FIG. 5, an end portion of the upstream side of the portion QA1 (groove portion 54) of the flow channel QA, communicates with the flow channel chamber RA through a communication hole H2 penetrating the base body 42. Moreover, as illustrated in FIG. 5 and FIG. 6, among the flow channel QA, the end portion of the downstream side of the portion QA1 (groove portion 54) of the first face 42A side, and the end portion of the upstream side of the portion QA2 (groove portion 66) of the second face 42B side communicate with each other through a communication hole H3 penetrating the base body 42.

A space which is surrounded by the internal face of the groove portion 68 of the second face 42B and the sealing face of the sealing body 46 correlates with the flow channel QB of FIG. 3. The end portion of the upstream side of the flow channel QB communicates with the flow channel chamber RB of the first face 42A side through a communication hole H4 penetrating the base body 42. Moreover, by forming the groove portion 68 so as to be continuous to the concave portion 64 within the face of the second face 42B, the end portion of the downstream end of the flow channel QB communicates with the flow channel chamber RC. On the other hand, a space which is surrounded by the internal face of the groove portion 56 of the first face 42A and the sealing face of the sealing body 44 correlates with the flow channel QC of FIG. 3. As illustrated in FIG. 5 and FIG. 6, the end portion of the upstream side of the flow channel QC communicates with the flow channel chamber RC of the second face 42B side through a communication hole H5 penetrating the base body 42, and the end portion of the downstream side of the flow channel QC communicates with the discharge flow channel P2 through a communication hole H6. A specific structure of the flow channel which is from the supply flow channel P1 to the discharge flow channel P2 is configured as described above.

Figure 7:
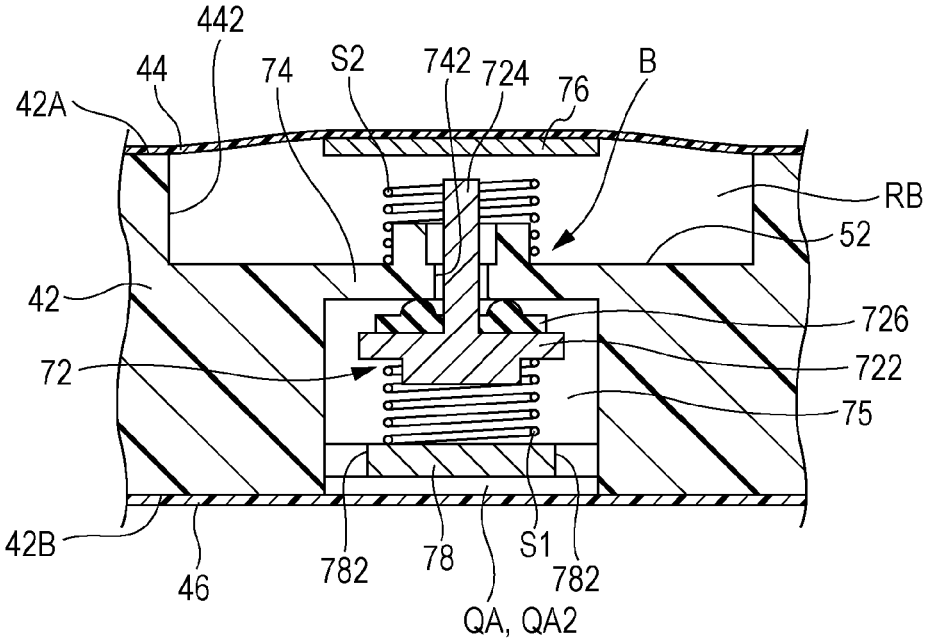
FIG. 7 is a sectional view taken along line VII-VII in FIG. 4.

FIG. 7 is a sectional view (sectional view of the flow channel chamber RB) taken along line VII-VII in FIG. 4. As illustrated in FIG. 7, the adjusting mechanism B of FIG. 3 is installed so as to overlap with the flow channel chamber RB in the planar view. As illustrated in FIG. 7, the adjusting mechanism B of the first embodiment includes a valve body 72, a valve seat 74, a pressure plate 76, a support plate 78, a spring S1, and a spring S2. The valve seat 74 is a portion which configures the bottom face of the flow channel chamber RB (concave portion 52), and faces the first wall portion 442 of the sealing body 44 at intervals. A communication hole 742 penetrating the base body 42 is formed in a central portion of the valve seat 74. The pressure plate 76 is a flat plate member of the substantially circular shape which is installed on a facing face (specifically, the central portion of the first wall portion 442) of the valve seat 74 among the first wall portion 442.

The support plate 78 is installed on the opposite side to the sealing body 44 (first wall portion 442) by interposing the valve seat 74 therebetween, and faces the valve seat 74 at intervals. A space (referred to as "valve chamber", hereinafter) 75 between the valve seat 74 and the support plate 78 communicates with the flow channel QA (portion QA2) through a communication hole (slit) 782 which is formed in the support plate 78. That is, a flow channel which reaches the flow channel chamber RB through the communication hole 782 of the support plate 78, the valve chamber 75, and the communication hole 742 of the valve seat 74 from the flow channel QA, is formed.

As illustrated in FIG. 7, the valve body 72 includes a base portion 722, a valve shaft 724, and a sealing portion (seal) 726. The valve shaft 724 perpendicularly protrudes from the surface of the base portion 722, and the sealing portion 726 of an annular shape which surrounds the valve shaft 724 in the planar view is installed on the surface of the base portion 722. The valve body 72 is installed so that the base portion 722 and the sealing portion 726 are positioned within the valve chamber 75 in a state where the valve shaft 724 is inserted into the communication hole 742 of the valve seat 74. That is, the base portion 722 and the sealing portion 726 of the valve body 72 are positioned on the opposite side to the pressure plate 76 (flow channel chamber RB) by interposing the valve seat 74 therebetween, and a tip portion of the valve shaft 724 that is inserted into the communication hole 742 of the valve seat 74 faces the pressure plate 76 within the flow channel chamber RB. The sealing portion 726 is positioned between the base portion 722 and the valve seat 74. A diameter of the valve shaft 724 is smaller than an internal diameter of the communication hole 742 of the valve seat 74. Therefore, a gap is formed between an inner circumferential face of the communication hole 742 of the valve seat 74 and an outer circumferential face of the valve shaft 724. The spring S1 of FIG. 7 biases the valve body 72 toward the valve seat 74 side by being installed between the support plate 78 and the base portion 722 of the valve body 72. On the other hand, the spring S2 is installed between the valve seat 74 and the pressure plate 76.

In the above configuration, since the sealing portion 726 is stuck and pressed to the surface of the valve seat 74 by that the spring S1 biases the valve body 72, the flow channel chamber RB and the valve chamber 75 are blocked, in the normal state where the pressure of the flow channel chamber RB is maintained within a predetermined range. That is, the flow channel QA is closed. On the other hand, for example, if the negative pressure within the flow channel chamber RB is increased due to the ejection of the ink by the liquid ejecting head 34 or the suction from the outside, the first wall portion 442 configuring the wall face of the flow channel chamber RB among the sealing body 44 is moved to the valve seat 74 side, and the pressure plate 76 which is installed in the first wall portion 442 presses the valve shaft 724 of the valve body 72 against the biasing by the spring S2. In other words, the first wall portion 442 functions as a diaphragm which is deformed depending on the pressure (negative pressure) within the flow channel chamber RB. If the negative pressure within the flow channel chamber RB is further increased, the sealing portion 726 is separated from the surface of the valve seat 74 by displacing the valve body 72 to the support plate 78 side against the biasing by the spring S1. Therefore, the valve chamber 75 communicating with the flow channel QA, communicates with the flow channel chamber RB through the communication hole 742 of the valve seat 74. That is, the channel QA is opened. In the state where the flow channel QA is opened, the ink which is supplied through the supply flow channel P1, the flow channel chamber RA and the flow channel QA from the liquid container 14, is supplied to the flow channel chamber RB through the valve chamber 75 and the communication hole 742. If the negative pressure of the flow channel chamber RB is decreased by the ink supply from the flow channel QA, the valve body 72 is displaced to the sealing body 44 side by the biasing of the spring S1, and the sealing portion 726 is in contact with the surface of the valve seat 74. In other words, the valve chamber 75 communicating with the flow channel QA, and the flow channel chamber RB are blocked. As understood from the above description, the valve body 72 of the first embodiment controls the opening and the closing (flow and blocking of the ink) between the flow channel QA and the flow channel chamber RB in accordance with the deformation of the first wall portion 442.

Figure 8:
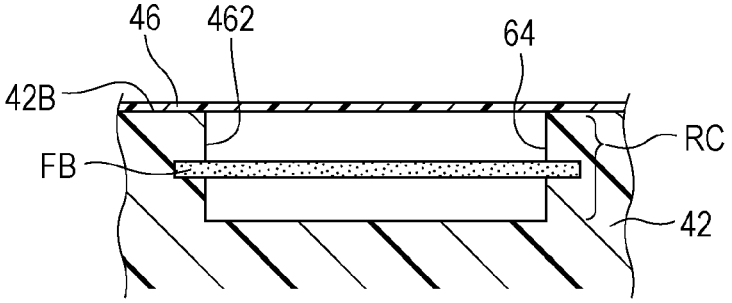
FIG. 8 is a sectional view taken along line VIII-VIII in FIG. 4.

Next, FIG. 8 is a sectional view (sectional view of the flow channel chamber RC) taken along line VIII-VIII in FIG. 4. As illustrated in FIG. 8, the filter FB of the circular shape is installed within the flow channel chamber RC. The filter FB is installed in the internal portion of the flow channel chamber RC so as to face a portion (referred to as "second wall portion", hereinafter) 462 which is positioned on the inside of the concave portion 64 among the sealing body 46 in the planar view at intervals, and to face the bottom face of the concave portion 64 at intervals. That is, the flow channel chamber RC is partitioned into the upstream side and the downstream side by interposing the filter FB therebetween.

As understood from the above description, the second wall portion 462 faces the filter FB by being installed on the second face 42B of the base body 42, and configures the wall face of the flow channel chamber RC. That is, in the first embodiment, the first wall portion 442 is installed on the first face 42A of the base body 42, and the second wall portion 462 is installed on the second face 42B which is the opposite side to the first face 42A. Therefore, there is an advantage that a size of the flow channel structure 32 may be reduced in comparison with a configuration of installing the first wall portion 442 and the second wall portion 462 on the surface of one side of the base body 42 so as not to overlap with each other. Furthermore, FIG. 7 focuses on the filter FB within the flow channel chamber RC, but the filter FA is installed in the flow channel chamber RA by the configuration which is similar thereto. That is, the filter FA is installed within the flow channel chamber RA so as to face each of the sealing face of the sealing body 46 and the bottom face of the concave portion 62 at intervals. The ink passes through to the first face 42A side from the second face 42B side in all of the filter FA and the filter FB.

In the first embodiment, the sealing body 44 and the sealing body 46 are different from each other in rigidity (bending rigidity). Specifically, the rigidity of the sealing body 44 is lower than the rigidity of the sealing body 46. That is, the sealing body 44 is likely to be deformed in comparison with the sealing body 46. For example, in a configuration in which the sealing body 44 and the sealing body 46 are formed into the same plate thicknesses, a Young's modulus EA of the sealing body 44 is smaller than a Young's modulus EB of the sealing body 46 (EA<EB). Moreover, in a configuration in which the sealing body 44 and the sealing body 46 are formed of materials of the same Young's modulus, a plate thickness TA of the sealing body 44 is smaller than a plate thickness TB of the sealing body 46 (TA<TB). As understood from the above description, the rigidity of the first wall portion 442 is lower than the rigidity of the second wall portion 462. In other words, the first wall portion 442 is set to the low rigidity so as to be deformed depending on the negative pressure of the flow channel chamber RB, and the second wall portion 462 configuring the wall face of the flow channel chamber RC is set to be the high rigidity so as not to be deformed even when the pressure of the flow channel chamber RC is changed.

In the configuration of JP-A-2011-46070, the filter for collecting the foreign material or the air bubbles of the liquid is installed in the space where the concave portion which is formed on the surface of the main body portion is sealed by the film. However, in the configuration in which the film faces the surface of the filter as described in JP-A-2011-46070, for example, when the film is deformed to the inside due to the occurrence of the negative pressure within the space, there is a possibility that the film is in contact with the surface of the filter. Since a flow channel area is reduced if the filter is partially closed by the contact of the film, a problem such as the increase of the pressure loss within the flow channel or the decrease of the foreign material collecting performance by the filter, occurs. On the other hand, in the first embodiment, since the rigidity of the second wall portion 462 is greater than the rigidity of the first wall portion 442, for example, the deformation of the second wall portion 462 is suppressed, in comparison with a configuration in which the rigidity of the second wall portion 462 is the same as the rigidity of the first wall portion 442. That is, for example, even when the negative pressure occurs in the flow channel QC due to the ejection of the ink by the liquid ejecting head 34 or the suction from the outside, the possibility of deforming the second wall portion 462 so as to be in contact with the filter FB is reduced. Therefore, the reduction of the flow channel area is suppressed by the contact with the second wall portion 462 and the filter FB, and it is possible to solve the problem such as the increase of the pressure loss or the decrease of the collecting performance of the filter FB. Moreover, there is a tendency that a time-dependent change of mechanical properties is unlikely to occur in the second wall portion 462 of the high rigidity in comparison with the member (for example, the first wall portion 442) of the low rigidity. Therefore, there is an advantage that the time-dependent change of flow channel properties of the flow channel structure 32 such as the pressure (holding pressure) of the flow channel chamber RB or the negative pressure (working pressure) of displacing the valve body 72 in the normal state where the flow channel QA is closed by the valve body 72 may be suppressed, in comparison with the configuration in which the rigidity of the second wall portion 462 is the same as the rigidity of the first wall portion 442.

As illustrated in FIG. 6, the filter FB has the large area (large diameter) in comparison with the filter FA. For example, the area of the filter FB is 50% or more (more preferably, 90% or more) of the area of the flow channel chamber RB, and is ideally the same (100%) as that of the flow channel chamber RB. On the other hand, the filter FA has the small area (small diameter) in comparison with the flow channel chamber RB. Moreover, the filter FB has a fine mesh in comparison with the filter FA. Specifically, an internal diameter of a through hole (or gap of the mesh) where the ink passes through in the filter FB is smaller than that of the filter FA. Therefore, the filter FB may collect the small foreign material or the small air bubbles in comparison with the filter FA of the upstream side. The flow channel resistance is apt to be increased as much as the mesh becomes fine, but in the first embodiment, since the filter FB is formed into the large area in comparison with the filter FA, there is an advantage that the flow channel resistance of the filter FB may be suppressed in comparison with a case where the area of the filter FB is the same as the area of the filter FA.

As understood from FIG. 5 and FIG. 6, in the first embodiment, the flow channel chamber RB and the filter FB (flow channel chamber RC) partially overlap with each other in the planar view. Therefore, for example, there is an advantage that the size of the flow channel structure 32 may be reduced as the overlapping portion of the flow channel chamber RB and the filter FB, in comparison with a configuration in which the flow channel chamber RB and the filter FB do not overlap with each other. In the first embodiment, since the filter FB of the large area is adopted in order to reduce the flow resistance as described above, an effect that the size of the flow channel structure 32 may be reduced by the overlapping of the flow channel chamber RB and the filter FB is particularly effective.

Figure 9:
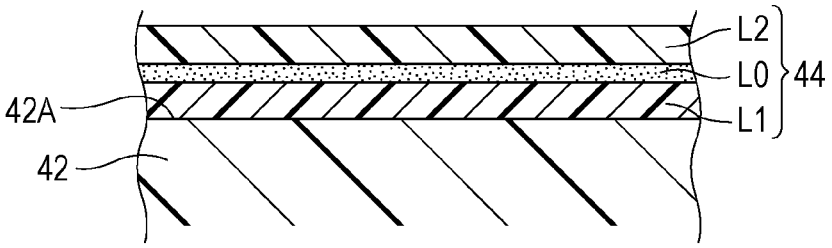
FIG. 9 is a diagram for describing a sealing body.

FIG. 9 is a sectional view of the sealing body 44. As illustrated in FIG. 9, the sealing body 44 of the first embodiment is configured by stacking a first layer L1, an adhesive layer L0, and a second layer L2. For example, the first layer L1 is formed of polypropylene (PP) in the same manner as the base body 42. For example, the second layer L2 is formed of polyethylene terephthalate (PET), and is bonded to the first layer L1 through the adhesive layer L0. The sealing body 44 is arranged on the first face 42A of the base body 42 in the state where the first layer L1 is positioned on the base body 42 side, and is welded to the base body 42 by pressing the sealing body 44 against the first face 42A from the second layer L2 side by a jig in the heating state. Since the second layer L2 is formed of polyethylene terephthalate, it is possible to easily peel off the jig from the surface of the sealing body 44 (second layer L2) after the completion of the welding. On the other hand, the sealing body 46 is formed of single layer of polypropylene in the same manner as the base body 42, and is welded to the second face 42B of the base body 42. The sealing body 46 (second wall portion 462) of the first embodiment is transparent. Specifically, transparency of the sealing body 46 is high in comparison with the sealing body 44. Therefore, there is an advantage that the air bubbles or the foreign materials which are collected by the filter FA or the filter FB may be visually confirmed through the sealing body 46 (in addition to that it is easily possible to determine whether or not an exchange of the filter FA or the filter FB is necessary). Furthermore, a configuration of forming the sealing body 46 by stacking a plurality of layers in the same manner as the illustration of FIG. 9 or a configuration of forming the sealing body 44 by single layer of polypropylene, for example, may be adopted.

Second Embodiment

A second embodiment of the invention will be described. In the effects and functions that are similar to the first embodiment in each embodiment which is described hereinafter, the detailed description thereof will be appropriately omitted by using the signs which are used in the description of the first embodiment.

Figure 10:
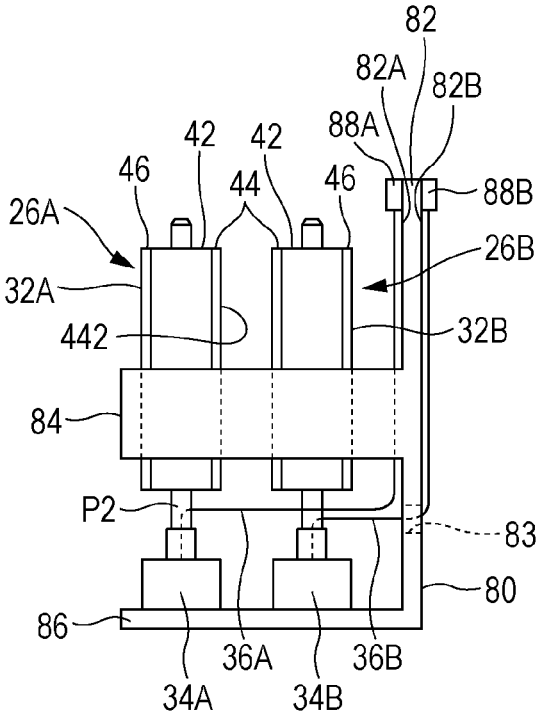
FIG. 10 is a diagram for describing support of a plurality of liquid ejecting units in a second embodiment.

FIG. 10 is a configuration diagram which is obtained by focusing on a structure of supporting a plurality of liquid ejecting units 26 among the printing apparatus 10 of the second embodiment. As illustrated in FIG. 10, the printing apparatus 10 of the second embodiment includes a liquid ejecting unit 26A, a liquid ejecting unit 26B, and a supporting body 80. Each of the liquid ejecting unit 26A and the liquid ejecting unit 26B include the flow channel structure 32 (32A, 32B), the liquid ejecting head 34 (34A, 34B), and the wiring circuit board 36 (36A, 36B), in the same manner as the first embodiment. Therefore, the effects which are similar to the first embodiment are realized in the second embodiment.

The supporting body 80 of FIG. 10 is a structure (frame) that supports the liquid ejecting unit 26A, and the liquid ejecting unit 26B, and is manufactured by a bending process with respect to, for example, a flat plate member made of metal. Specifically, the supporting body 80 of the second embodiment includes a main body portion 82, a fixing portion 84, and a fixing portion 86. The main body portion 82 is a flat plate-shaped portion including a first face 82A, and a second face 82B which are positioned on the opposite sides to each other. The fixing portion 84, and the fixing portion 86 are installed on the first face 82A side of the main body portion 82.

The fixing portion 84 is a flat plate-shaped portion extending over the flow channel structure 32A of the liquid ejecting unit 26A and the flow channel structure 32B of the liquid ejecting unit 26B, and supports the flow channel structure 32A, and the flow channel structure 32B on the first face 82A side of the main body portion 82 in the state of being arranged at intervals to each other. As illustrated in FIG. 10, the flow channel structure 32A, and the flow channel structure 32B are supported in the state where each of the sealing bodies 44 face each other at intervals (state where the sealing body 46 is positioned on the opposite side to each other). In other words, the first wall portion 442 of the flow channel structure 32A of the liquid ejecting unit 26A, and the first wall portion 442 of the flow channel structure 32B of the liquid ejecting unit 26B face each other at intervals. As described above, in the second embodiment, since the liquid ejecting unit 26A, and the liquid ejecting unit 26B are installed so that the sealing bodies 44 of the rigidity which is low in comparison with the sealing body 46 face each other, for example, there is an advantage that the sealing body 44 of each flow channel structure 32 may be protected from a collision with an external component, for example, as compared with a configuration where the liquid ejecting unit 26A, and the liquid ejecting unit 26B are installed so that the sealing bodies 44 are positioned on the opposite sides to each other.

On the other hand, the fixing portion 86 of the supporting body 80 is a flat plate-shaped portion extending over the liquid ejecting head 34A of the liquid ejecting unit 26A and the liquid ejecting head 34B of the liquid ejecting unit 26B, and supports the liquid ejecting head 34A, and the liquid ejecting head 34B in the state of being arranged at intervals to each other. As illustrated in FIG. 10, both of the liquid ejecting unit 26A and the liquid ejecting unit 26B are supported on the first face 82A side of the main body portion 82.

The wiring circuit board 36B of the liquid ejecting unit 26B which is positioned on the main body portion 82 side when viewed from the liquid ejecting unit 26A, is inserted into a through hole 83 which is formed in the main body portion 82, and is extended upwards in a vertical direction along the second face 82B of the main body portion 82, and the tip portion thereof is linked to a connection terminal (connector) 88B on the second face 82B. On the other hand, the wiring circuit board 36A of the liquid ejecting unit 26A which is positioned on the opposite side to the main body portion 82 when viewed from the liquid ejecting unit 26B, is bent on the face of the first face 82A of the main body portion 82 by passing through between the flow channel structure 32A and the liquid ejecting head 34A of the liquid ejecting unit 26A, and is extended upwards in the vertical direction along the first face 82A, and the tip portion thereof is linked to a connection terminal 88A on the first face 82A. As understood from the above description, the wiring circuit board 36A of the liquid ejecting unit 26A, and the wiring circuit board 36B of the liquid ejecting unit 26B are positioned on the opposite sides to each other by interposing the main body portion 82 of the supporting body 80 therebetween. In the above configuration, since the main body portion 82 made of metal which is interposed between the wiring circuit board 36A and the wiring circuit board 36B functions as a shield, there is an advantage that a noise with respect to the other from one of the wiring circuit board 36A and the wiring circuit board 36B may be reduced. Furthermore, it is possible to use the main body portion 82 in earthing of both of the wiring circuit board 36A and the wiring circuit board 36B.

Third Embodiment

Figure 11:
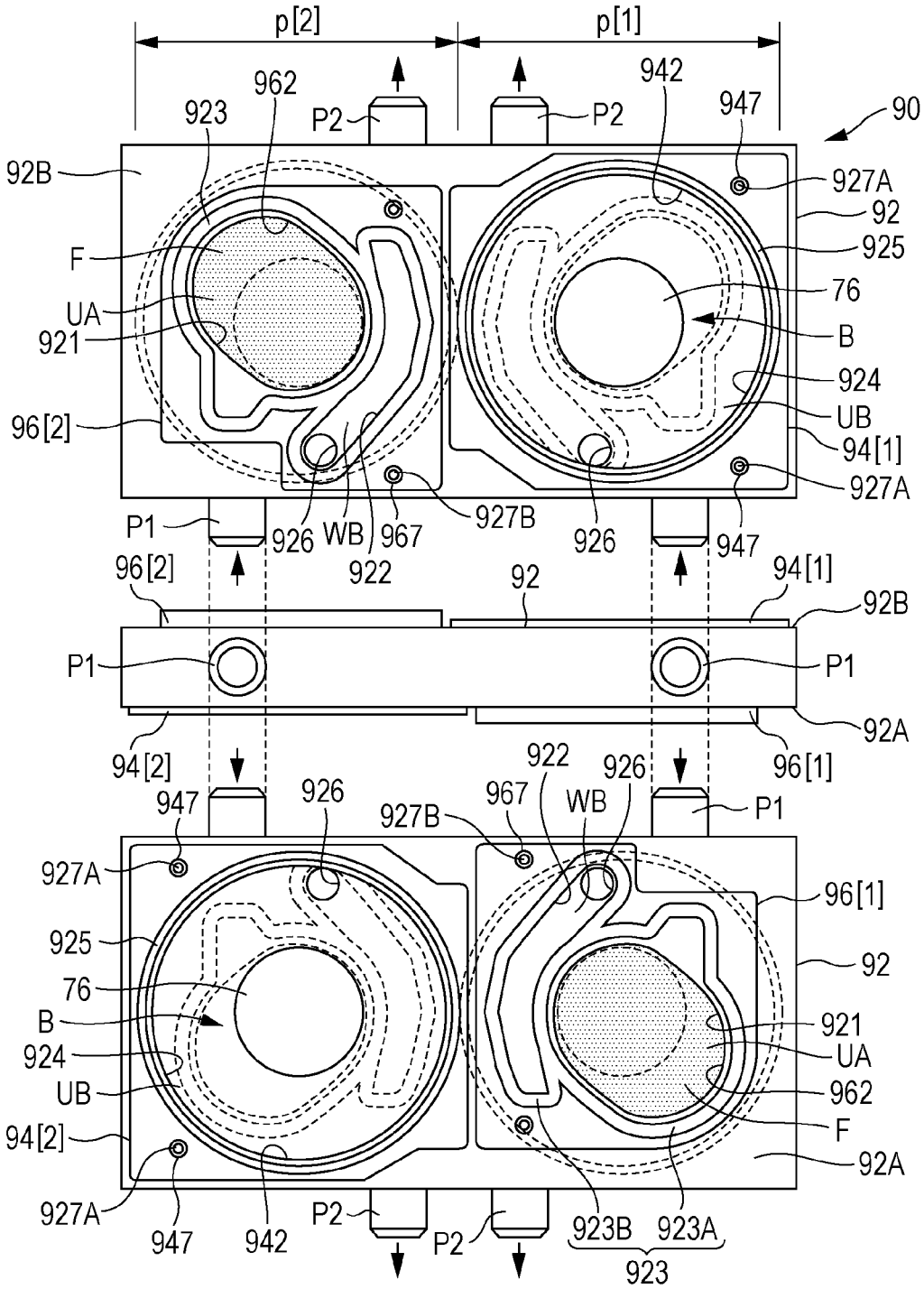
FIG. 11 is a plan view of a flow channel structure in a third embodiment.

In a third embodiment, the flow channel structure 32 of the first embodiment is replaced with a flow channel structure 90 of FIG. 11. The flow channel structure 90 of the third embodiment includes a flow channel p[1], and a flow channel p[2] which are independent from each other. Each of the flow channel p[1] and the flow channel p[2] are flow channels for supplying the ink which is supplied to the supply flow channel P1 to the discharge flow channel P2, and are independently formed without communicating with each other.

Figure 12:
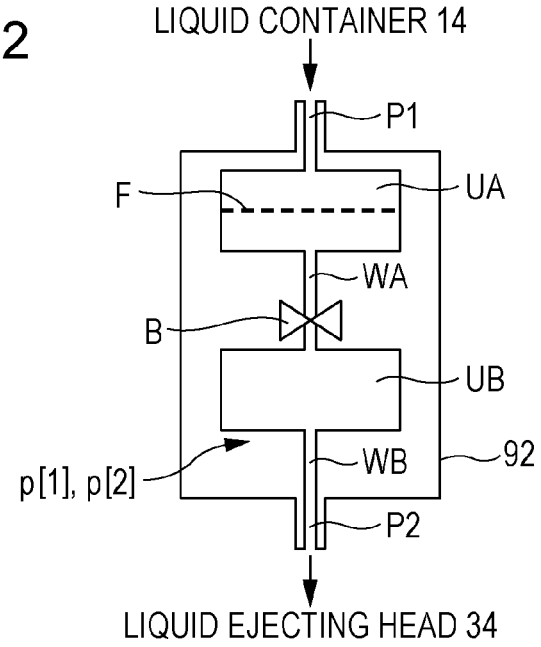
FIG. 12 is a diagram for describing an internal flow channel of the flow channel structure in the third embodiment.

FIG. 12 is a diagram for describing each of the flow channel p[1] and the flow channel p[2]. As illustrated in FIG. 12, each of the flow channel p[1] and the flow channel p[2] of the third embodiment, include a flow channel WA, a flow channel WB, a flow channel chamber UA, and a flow channel chamber UB between the supply flow channel P1 and the discharge flow channel P2. The flow channel chamber UA is a space (example of the second flow channel chamber) communicating with each of the supply flow channel P1 and the flow channel WA by being formed therebetween. A filter F (example of the first filter) that collects the air bubbles or the foreign material from the ink which is supplied to the flow channel chamber UA from the supply flow channel P1, is installed in the flow channel chamber UA.

The flow channel chamber UB is a space (example of the first flow channel chamber) communicating with each of the flow channel WA and the flow channel WB by being formed therebetween. The adjusting mechanism B is installed between the flow channel chamber UB and the flow channel chamber UA (on the flow channel WA). The adjusting mechanism B of the third embodiment is a valve mechanism that controls the flow and the blocking of the ink of the flow channel WA depending on the pressure (negative pressure) within the flow channel chamber UB, in the same manner as the first embodiment. The ink flowing into the flow channel chamber UB from the flow channel WA is supplied to the flow channel WB in the state where the adjusting mechanism B opens the flow channel WA, and is supplied to the liquid ejecting head 34 from the discharge flow channel P2 communicating with the flow channel WB. As understood from the above description, in the third embodiment, the flow channel chamber UA and the flow channel chamber UB communicate with each other, and the flow channel chamber UA (second flow channel chamber) is positioned on the upstream side of the flow channel chamber UB (first flow channel chamber). For example, the ink which is pressurized by a pressurizing mechanism (not illustrated) such as a pump, is supplied from the liquid container 14 to the flow channel chamber UA. Therefore, the internal pressure of the flow channel chamber UA is high in comparison with the flow channel chamber UB. For example, the internal pressure of the flow channel chamber UA is maintained at a predetermined value within the range of 30 kPa or more and 40 kPa or less (more preferably, 35±3 [kPa]).

As illustrated in FIG. 11, the flow channel structure 90 of the third embodiment is a structure where a sealing body 94[1] and a sealing body 96[1] correlating with the flow channel p[1], and a sealing body 94[2] and a sealing body 96[2] correlating with the flow channel p[2] are joined to a base body 92. The base body 92 is a structure of a substantially flat plate shape that includes a first face 92A, and a second face 92B which are positioned on opposite sides to each other. For example, the base body 92 is formed by the injection molding of a resin material (for example, polypropylene) of light-shielding properties. As illustrated in FIG. 11, each supply flow channel P1 of the channel p[1] and the channel p[2] is formed on the upper face of the base body 92, and each discharge flow channel P2 of the channel p[1] and the channel p[2] is formed on the bottom face of the base body 92. Furthermore, in the following description, the sealing body 94 is written when the sealing body 94[1] and the sealing body 94[2] are not necessary to be particularly classified, and the sealing body 96 is written when the sealing body 96[1] and the sealing body 96[2] are not necessary to be particularly classified. The sealing body 94 is an example of the first sealing body, and the sealing body 96 is an example of the second sealing body.

For example, the sealing body 94 and the sealing body 96 are flat plate members of light-transmitting properties which are formed of the resin materials such as polypropylene in the same manner as the base body 92. The sealing body 94 and the sealing body 96 are different from each other in rigidity (bending rigidity). Specifically, the rigidity of the sealing body 94 is low in comparison with the sealing body 96, and the sealing body 94 is likely to be deformed. For example, the sealing body 94 is a film of flexibility, and the sealing body 96 is a hard flat plate member of which the plate thickness is greater than that of the sealing body 94.

As understood from FIG. 11, the sealing body 96[1] of the flow channel p[1] and the sealing body 94[2] of the flow channel p[2] are fixed to the first face 92A side of the base body 92, and the sealing body 94[1] of the flow channel p[1] and the sealing body 96[2] of the flow channel p[2] are fixed to the second face 92B side of the base body 92. The sealing body 94[1] and the sealing body 96[1] face each other by interposing the base body 92 therebetween, and the sealing body 94[2] and the sealing body 96[2] face each other by interposing the base body 92 therebetween.

A plurality of protruding portions 927A, and a plurality of protruding portions 927B are formed on each of the first face 92A and the second face 92B of the base body 92. On the other hand, a plurality of protruding engagement portions 947 are formed in the sealing body 94, and a plurality of protruding engagement portions 967 are formed in the sealing body 96. The protruding engagement portion 947 is a through hole or a bottomed hole which engages with the protruding portion 927A, and the protruding engagement portion 967 is a through hole or a bottomed hole which engages with the protruding portion 927B. A position of a surface direction of the sealing body 94 is determined (positioned) by that each protruding engagement portion 947 of the sealing body 94 engages with the protruding portion 927A of the base body 92. Similarly, the position of the surface direction of the sealing body 96 is determined by that each protruding engagement portion 967 of the sealing body 96 engages with the protruding portion 927B of the base body 92.

As illustrated in FIG. 11, a concave portion 921, a groove portion 922, and a joining portion 923 are formed in a region which is covered by the sealing body 96[1] among the first face 92A of the base body 92. The concave portion 921, and the groove portion 922 are hollow portions which are low in comparison with the first face 92A. The concave portion 921 communicates with the supply flow channel P1, and the end portion of the bottom face side of the base body 92 among the groove portion 922 communicates with the discharge flow channel P2.

The joining portion 923 is a portion protruding from the first face 92A. As illustrated in FIG. 11, the joining portion 923 of the third embodiment includes a first portion 923A, and a second portion 923B. The first portion 923A is formed into a ring shape which surrounds the concave portion 921 in the planar view, and the second portion 923B is formed into the ring shape which surrounds the groove portion 922 in the planar view. The first portion 923A, and the second portion 923B have the same portion between the concave portion 921 and the groove portion 922. That is, a portion (partition wall) between the concave portion 921 and the groove portion 922 among the joining portion 923 is shared as the first portion 923A and the second portion 923B. Therefore, the area which is necessary for the formation of the joining portion 923 is reduced in comparison with a configuration in which the first portion 923A, and the second portion 923B are formed by being separated from each other. As a result, there is an advantage that the flow channel structure 90 may be miniaturized.

Figure 13:
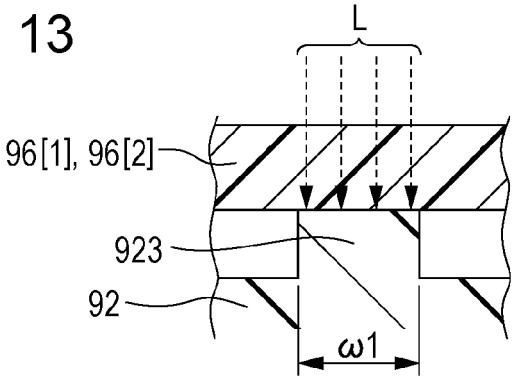
FIG. 13 is a diagram for describing a joining portion and a sealing body in the third embodiment.

As illustrated in FIG. 13, the sealing body 96[1] is joined to a top face of the joining portion 923. Although a known method may be optionally adopted for joining the sealing body 96[1] to the joining portion 923, a laser welding of joining the sealing body 96[1] by irradiating and melting the joining portion 923 with a laser beam L, is suitable. Specifically, as illustrated in FIG. 13, the sealing body 96[1] is irradiated with the laser beam L from the opposite side to the base body 92 by interposing the sealing body 96[1] therebetween. The laser beam L melts the top face facing the sealing body 96[1] among the joining portion 923, by being transmitted through the sealing body 96[1] of the light-transmitting properties, and being absorbed with the base body 92 (joining portion 923) of the light-shielding properties. The sealing body 96[1], and the joining portion 923 are joined by pressing the sealing body 96[1] to the joining portion 923 in the above state.

As illustrated in FIG. 11, a space which is surrounded by the internal face of the concave portion 921 and the facing face (sealing face) of the base body 92 side among the sealing body 96[1] functions as the flow channel chamber UA, and a space which is surrounded by the internal face of the groove portion 922 and the sealing face of the sealing body 96[1] functions as the flow channel WB. As understood from the above description, the first portion 923A of the joining portion 923 surrounds the flow channel chamber UA in the planar view, and the second portion 923B surrounds the flow channel WB in the planar view. The filter F illustrated in FIG. 12 is installed in the flow channel chamber UA. As understood from FIG. 11, the second wall portion 962 which is positioned on the inside of the concave portion 921 among the sealing body 96[1] in the planar view, configures the wall face of the flow channel chamber UA, and faces the filter F of the flow channel chamber UA at intervals.

As illustrated in FIG. 11, the concave portion 924, and the joining portion 925 are formed in a region which is covered by the sealing body 94[1] correlating with the flow channel p[1] among the second face 92B of the base body 92. The concave portion 924 is a hollow portion of the circular shape which is low in comparison with the second face 92B. The concave portion 924 communicates with the flow channel chamber UA of the first face 92A side through the flow channel WA (not illustrated in FIG. 11) where the adjusting mechanism B is installed, and communicates with the groove portion 922 (flow channel WB) of the first face 92A side through a communication hole 926 communicating with the base body 92.

Figure 14:
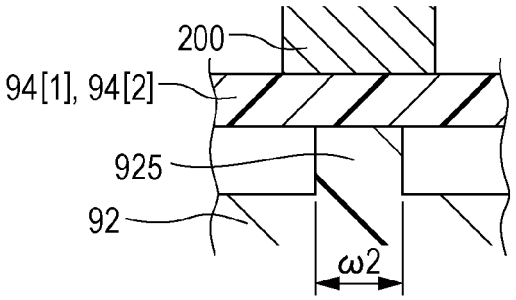
FIG. 14 is a diagram for describing the joining portion and the sealing body in the third embodiment.

The joining portion 925 is a portion protruding from the second face 92B. As understood from FIG. 11, the joining portion 925 is formed into the ring (annular) shape which surrounds the concave portion 924 in the planar view. As illustrated in FIG. 14, the sealing body 94[1] is joined to the top face of the joining portion 925. Although the known method may be optionally adopted for joining the sealing body 94[1] to the joining portion 925, a hot plate welding of joining the sealing body 94[1] by melting the joining portion 925 with the pressing of the sealing body 94[1] due to a heating face of a jig (hot plate) 200, is suitable. As understood from FIG. 13 and FIG. 14, a width ω1 of the joining portion 923 to which the flat plate-shaped sealing body 96[1] is joined, is greater than a width ω2 of the joining portion 925 to which the film-shaped sealing body 94[1] is joined.

As illustrated in FIG. 11, a space which is surrounded by the internal face of the concave portion 924 and the sealing face of the base body 92 side among the sealing body 94[1] functions as the flow channel chamber UB. The first wall portion 942 which is positioned on the inside of the concave portion 924 among the sealing body 94[1] in the planar view, configures the wall face of the flow channel chamber UB. As understood from the above description, the flow channel p[1] where the ink flows through a route of the supply flow channel P1→the flow channel chamber UA (concave portion 921)→the flow channel WB→the flow channel chamber UB (concave portion 924)→the communication hole 926→the flow channel WB (groove portion 922)→the discharge flow channel P2, is formed. The flow channel chamber UA and the flow channel chamber UB of the flow channel p[1] overlap with each other in the planar view.

The flow channel p[2] is formed in the same manner as the flow channel p[1], except for a point of reversing the inside and the outside of the base body 92 to the flow channel p[1]. Specifically, the concave portion 924, and the joining portion 925 are formed on the first face 92A of the base body 92, and the sealing body 94[2] is joined to the joining portion 925, and a space which is surrounded by the internal face of the concave portion 924 and the sealing face of the sealing body 94[2] functions as the flow channel chamber UB. On the other hand, the concave portion 921, the groove portion 922, and the joining portion 923 are formed on the second face 92B of the base body 92, and the sealing body 96[2] is joined to the joining portion 923. A space which is surrounded by the internal face of the concave portion 921 and the sealing face of the sealing body 96[2] functions as the flow channel chamber UA, and a space which is surrounded by the internal face of the groove portion 922 and the sealing face of the sealing body 96[2] functions as the flow channel chamber UB.

Figure 15:
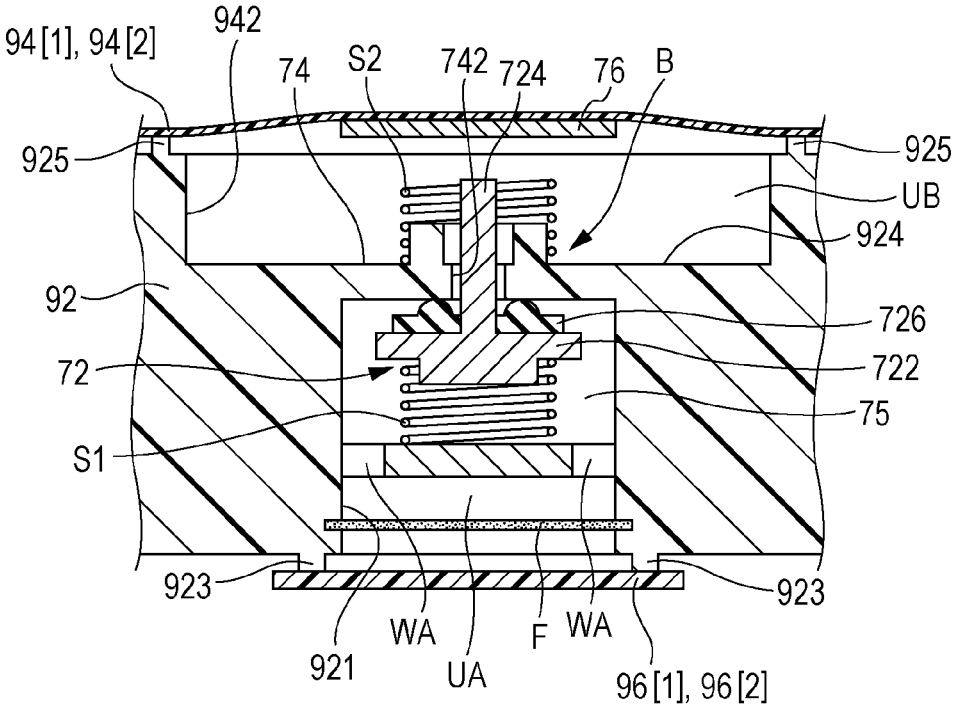
FIG. 15 is a sectional view for describing the vicinity of an adjusting mechanism in the third embodiment.

FIG. 15 is a sectional view of the flow channel structure 90 which is obtained by focusing on a relationship between the flow channel chamber UA and the flow channel chamber UB in each of the flow channel p[1] and the flow channel p[2]. As illustrated in FIG. 15, the flow channel chamber UA, and the flow channel chamber UB communicate with each other through the flow channel WA. The adjusting mechanism B is configured in the same manner as the first embodiment, and is installed between the flow channel WA and the flow channel chamber UB. As illustrated in FIG. 15, the adjusting mechanism B of the third embodiment is installed so as to overlap with the flow channel chamber UA and the flow channel chamber UB in the planar view.

The pressure plate 76 of the adjusting mechanism B is installed in each first wall portion 942 of the sealing body 94[1] and the sealing body 94[2]. The valve body 72 of the adjusting mechanism B controls the flow and the blocking of the ink (opening and the closing of the flow channel WA) between the flow channel chamber UA and the flow channel chamber UB in accordance with the deformation of the first wall portion 942. A specific behavior of the valve body 62 is similar to the first embodiment. That is, for example, if the negative pressure within the flow channel chamber UB is increased due to the ejection of the ink by the liquid ejecting head 34 or the suction from the outside, the flow channel chamber UA, and the flow channel chamber UB communicate with each other by displacing the valve body 72 on the opposite side to the first wall portion 942. On the other hand, if the negative pressure of the flow channel chamber UB is decreased by the supply of the ink from the flow channel chamber UA, the flow through the flow channel chamber UA and the flow channel chamber UB is blocked, by displacing the valve body 72 on the first wall portion 942 side by the biasing of the spring S1.

In the state where the adjusting mechanism B blocks the flow channel chamber UA and the flow channel chamber UB, the internal pressure of the flow channel chamber UA is greater than that of the flow channel chamber UB due to the supply of the ink which is pumped from the liquid container 14. Therefore, there is the possibility that the deformation or the breakage (for example, the peel-off of the sealing body 96) of the flow channel chamber UA occurs, in a configuration of forming the sealing body 96 that configures the wall face of the flow channel chamber UA into the film shape which is similar to the sealing body 94 of the flow channel chamber UB. In the third embodiment, since the rigidity of the sealing body 96 configuring the flow channel chamber UA is greater than the rigidity of the sealing body 94 of the flow channel chamber UB, there is an advantage that the possibility of the deformation or the breakage of the flow channel chamber UB may be reduced. Moreover, if the filter F is partially closed by that the sealing body 96 is in contact with the filter F due to the deformation, the problem such as the increase of the pressure loss within the flow channel or the decrease of the foreign material collecting performance by the filter F, may occur. In the third embodiment, since the deformation of the sealing body 96 is suppressed, there is an advantage that the above-described problem which is caused by the contact with the sealing body 96 and the filter F may be suppressed.

Various types of configurations which are described in the first embodiment may be also applied to the third embodiment in the same manner. Moreover, various types of configurations which are described in the third embodiment may be also applied to the first embodiment. It is possible to apply the configuration of the second embodiment to the third embodiment (that is, to replace the flow channel structure 32 of FIG. 10 with the flow channel structure 90 of the third embodiment).

Figure 16:
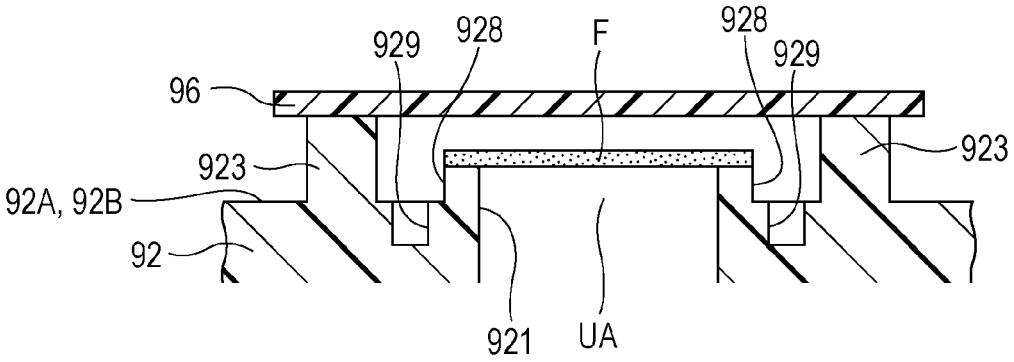
FIG. 16 is a configuration diagram of Modification Example of the third embodiment.

Furthermore, a structure for installing the filter F in the flow channel chamber UA is optional, and for example, it is possible to adopt the structure illustrated in FIG. 16. In the configuration of FIG. 16, the joining portion 923 protruding from the surface (first face 92A or second face 92B) of the base body 92, and an installation portion 928 are formed. The installation portion 928 is formed into the ring shape correlating with an outer shape of the filter F. In the same manner as the third embodiment, for example, the sealing body 96 configuring the flow channel chamber UA is fixed to the joining portion 923 by the laser welding. On the other hand, the filter F of the flow channel chamber UA is fixed to the installation portion 928. The known method may be optionally adopted for fixing the filter F to the installation portion 928, but for example, a welding technology such as the hot plate welding or the laser welding is suitable.

As illustrated in FIG. 16, a groove portion 929 is formed in the region between the joining portion 923 and the installation portion 928 among the surface of the base body 92. The groove portion 929 is a hollow portion which is low in comparison with the surface of the base body 92, and is used for the heat radiation in the process of installing the filter F in the installation portion 928. Specifically, the heat radiating in the vicinity at the time of heating the installation portion 928 radiates in the outside air by the groove portion 929. Therefore, there is an advantage that the heat deformation (in addition to the decrease of flatness of an installing face of the sealing body 94) of the joining portion 923 is suppressed in comparison with a configuration in which the groove portion 929 is not formed. Furthermore, the configuration of FIG. 16 may be similarly applied to the first embodiment.

Modification Example

Each embodiment described above may be variously modified. Hereinafter, a specific modified embodiment will be described. The embodiments of two or more which are optionally selected from the following description, may be appropriately combined within the range where the embodiments are not inconsistent with each other.

(1) In the first embodiment and the second embodiment, the filter FA of the upstream side and the filter FB of the downstream side of the flow channel chamber RB are described, but one of the filter FA and the filter FB may be omitted. A configuration of omitting the filter F of the third embodiment may be also adopted. Moreover, in each embodiment described above, the flow channel structure 32 is coupled with the liquid ejecting head 34, but a division flow channel which divides the ink into a plurality of routes or a valve mechanism which controls the pressure of the ink may be installed between the flow channel structure 32 and the liquid ejecting head 34.

(2) In the third embodiment, the position of the surface direction of the sealing body 94 is determined by that the protruding engagement portion 947 of the sealing body 94 engages with the protruding portion 927A of the base body 92, and the position of the surface direction of the sealing body 96 is determined by that the protruding engagement portion 967 of the sealing body 96 engages with the protruding portion 927B of the base body 92, but the configuration for the positioning of the sealing body 94 and the sealing body 96 is not limited to the above embodiments.

Figure 17:
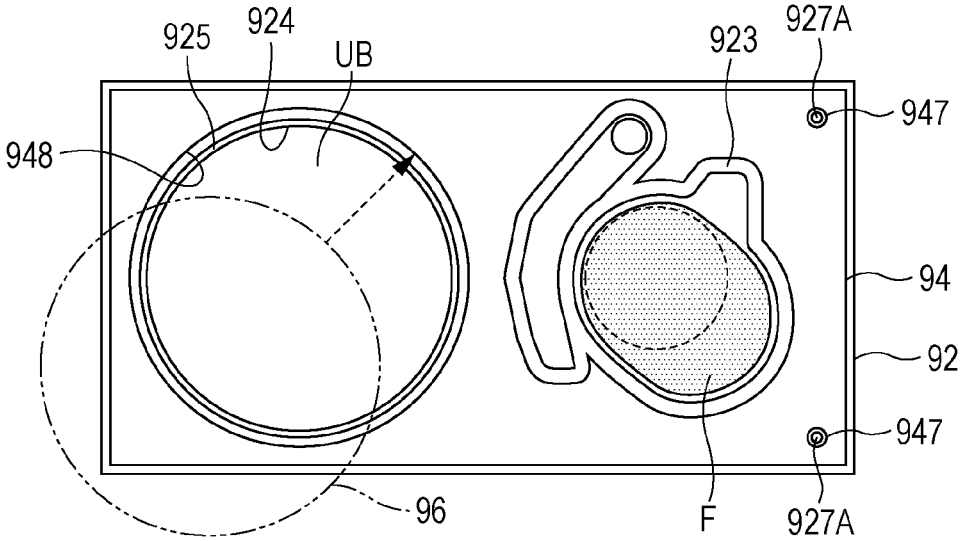
FIG. 17 is a diagram for describing positioning of a sealing body in Modification Example.

For example, as illustrated in FIG. 17, the configuration of forming a sealing body engagement portion 948 in the sealing body 94 is assumed. The sealing body engagement portion 948 is an opening of the shape (the substantially circular shape) correlating with the outer shape of the sealing body 96. In the sealing body 94, the position of the surface direction is determined by that the protruding engagement portion 947 engages with the protruding portion 927A of the base body 92 (or other configurations), in the same manner as the third embodiment. On the other hand, in the sealing body 96, the position of the surface direction is determined by engaging with the sealing body engagement portion 948 of the sealing body 94. According to the above configuration, there is an advantage that the protruding engagement portion 967 of the sealing body 96 or the protruding portion 927B of the base body 92 is not necessary.

Figure 18:
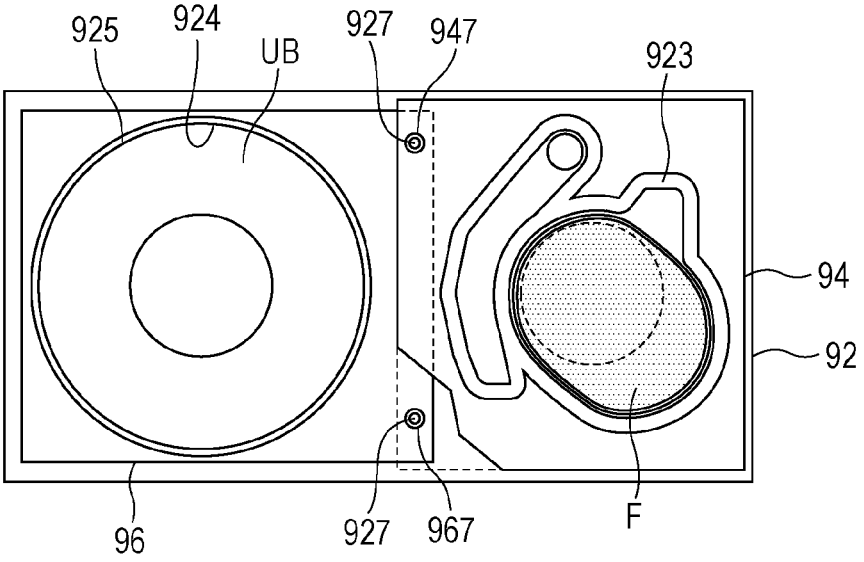
FIG. 18 is a diagram for describing the positioning of the sealing body in Modification Example.

Moreover, as illustrated in FIG. 18, it is possible to use the protruding portion 927 which is common in the base body 92 for the positioning of both of the sealing body 94 and the sealing body 96. In FIG. 18, a portion of the sealing body 94 is illustrated by being conveniently broken. As illustrated in FIG. 18, the plurality of protruding engagement portions 947 are formed in the sealing body 94, and the plurality of protruding engagement portions 967 are formed in the sealing body 96, and both of the protruding engagement portion 947 of the sealing body 94 and the protruding engagement portion 967 of the sealing body 96 engage with each other in each of the plurality of protruding portions 927 which are formed on the surface of the base body 92. The sealing body 94 and the sealing body 96 partially overlap with each other. According to the configuration of FIG. 18, since the common protruding portion 927 is used for the positioning of both of the sealing body 94 and the sealing body 96, there is an advantage that the protruding portion 927A for the sealing body 94, and the protruding portion 927B for the sealing body 96 are not necessary to be separately formed.

(3) In each embodiment described above, a serial head where the carriage 28 in which the plurality of liquid ejecting units 26 are mounted reciprocates in the X direction is described, but a line head where the plurality of liquid ejecting units 26 extending over the total width of the medium 12 in the X direction are arrayed may be applied to the invention.

(4) A drive element causing the ink to be ejected from each nozzle N of the liquid ejecting head 34 is not limited to the piezoelectric element which is described in each embodiment described above. For example, it is possible to use a heat generating element (heater) causing the ink to be ejected from the nozzle N by changing the pressure of the pressure chamber in the occurrence of the air bubbles due to the heating as a drive element. The piezoelectric element or the heat generating element is generically expressed as a drive element (specifically, a pressure granting element which changes the pressure of the pressure chamber) causing the liquid to be ejected from the nozzle, and an operating system (piezo system or thermal system) of the drive element or a specific configuration thereof is unmentioned.

(5) The printing apparatus 10 which is described in each embodiment described above, may be adopted in various types of devices such as a facsimile apparatus or a copying machine, in addition to a single-purpose device for the printing. However, an application of the liquid ejecting apparatus of the invention is not limited to the printing. For example, a liquid ejecting apparatus which ejects a solution of a color material is used as a manufacturing apparatus which forms a color filter of a liquid crystal display apparatus. Moreover, a liquid ejecting apparatus which ejects a solution of a conductive material is used as a manufacturing apparatus which forms a wiring or an electrode of a wiring circuit board.

CROSS-REFERENCE TO RELATED APPLICATIONS

This application claims priority to Japanese Patent Application No. 2014-218731 filed on Oct. 27, 2014 and Japanese Patent Application No. 2015-136376 filed on Jul. 7, 2015. The entire disclosures of Japanese Patent Application Nos. 2014-218731 and 2015-136376 are hereby incorporated herein by reference.

What is claimed is:

1. A flow channel structure comprising:

a first flow channel chamber to which a liquid is supplied;

a first sealing body that configures a wall face of the first flow channel chamber;

a valve body configured to control flow and blocking of the liquid in accordance with deformation of the first sealing body;

a second flow channel chamber that communicates with the first flow channel chamber;

a second sealing body that configures a wall face of the second flow channel chamber; and a single structure base body that defines the first flow channel chamber and the second flow channel chamber, and the first sealing body and the second sealing body contacting the base body so as to be fixed to the base body, wherein the rigidity of the second sealing body is greater than the rigidity of the first sealing body.

2. The flow channel structure according to claim 1, wherein the second flow channel chamber is positioned on an upstream side of the first flow channel chamber, and an internal pressure of the second flow channel chamber is higher than that of the first flow channel chamber.

3. The flow channel structure according to claim 2, wherein the internal pressure of the second flow channel chamber is from 30 kPa to 40 kPa.

4. The flow channel structure according to claim 3, wherein a first filter is fixed to an installation portion which protrudes from a surface of the base body, the second sealing body is fixed to a joining portion which protrudes from the surface of the base body, and a groove portion for heat radiation is formed between the installation portion and the joining portion in the base body.

5. The flow channel structure according to claim 2, further comprising:

a first filter that faces the second sealing body by being installed in the second flow channel chamber.

6. The flow channel structure according to claim 1, further comprising:

a protruding portion that is installed on a surface of the base body, wherein a protruding engagement portion which engages with the protruding portion is formed in the second sealing body.

7. The flow channel structure according to claim 6, wherein a protruding engagement portion which engages with the protruding portion is formed in the first sealing body.

8. The flow channel structure according to claim 1, wherein a sealing body engagement portion of a shape correlating with the first sealing body is formed in the second sealing body, and the first sealing body engages with the sealing body engagement portion.

9. The flow channel structure according to claim 1, wherein the second sealing body is fixed to a joining portion which protrudes from the surface of the base body, the joining portion includes a first portion surrounding the second flow channel chamber in a planar view, and a second portion surrounding a flow channel which communicates with the second flow channel chamber in the planar view, and the first portion and the second portion have the same portion between the second flow channel chamber and the flow channel.

10. The flow channel structure according to claim 1, further comprising:

a first filter that faces the second sealing body by being installed in the second flow channel chamber, wherein the second flow channel chamber is positioned on a downstream side of the first flow channel chamber.

11. The flow channel structure according to claim 10, further comprising:

a base body that includes a first face and a second face which are positioned on opposite sides to each other, wherein the first sealing body is installed on the first face, and the second sealing body is installed on the second face.

12. The flow channel structure according to claim 10, further comprising:

a second filter that is arranged on an upstream side of the first flow channel chamber, wherein the first filter has a fine mesh, and a large area in comparison with the second filter.

13. The flow channel structure according to claim 10, wherein at least a portion of the first filter, and at least a portion of the first flow channel chamber overlap with each other when viewed from a direction which is perpendicular to the wall face of the first sealing body or the second sealing body.

14. The flow channel structure according to claim 10, wherein the area of the first filter is 50% or more of the area of the first flow channel chamber.

15. The flow channel structure according to claim 10, wherein the second sealing body is transparent.

16. The flow channel structure according to claim 1, wherein the base body absorbs a laser beam, and the second sealing body transmits the laser beam.

17. A liquid ejecting apparatus comprising:

the flow channel structure according to claim 1; and a liquid ejecting head that is configured to eject a liquid which is supplied from the flow channel structure.

18. A liquid ejecting apparatus comprising:

the flow channel structure according to claim 2; and a liquid ejecting head that is configured to eject a liquid which is supplied from the flow channel structure.

19. A liquid ejecting apparatus comprising:

a first liquid ejecting unit including the flow channel structure according to claim 1, and a liquid ejecting head that is configured to eject a liquid which is supplied from the flow channel structure; and a second liquid ejecting unit including the flow channel structure according to claim 1, and a liquid ejecting head that ejects a liquid which is supplied from the flow channel structure, wherein the first sealing body of the flow channel structure of the first liquid ejecting unit, and the first sealing body of the flow channel structure of the second liquid ejecting unit face each other.

20. A flow channel structure comprising:

a first flow channel chamber to which a liquid is supplied;

a first sealing body that configures a wall face of the first flow channel chamber;

a valve body that configured to control flow and blocking of the liquid in accordance with deformation of the first sealing body;

a second flow channel chamber that communicates with the first flow channel chamber; and a second sealing body that configures a wall face of the second flow channel chamber;

wherein the rigidity of the second sealing body is greater than the rigidity of the first sealing body, wherein the second sealing body is fixed to a joining portion which protrudes from the surface of the base body, the joining portion includes a first portion surrounding the second flow channel chamber in a planar view, and a second portion surrounding a flow channel which communicates with the second flow channel chamber in the planar view, and the first portion and the second portion have the same portion between the second flow channel chamber and the flow channel.

* * * * *